US006795047B2

(12) United States Patent
Kudo et al.

(10) Patent No.: US 6,795,047 B2
(45) Date of Patent: Sep. 21, 2004

(54) LIQUID CRYSTAL DRIVER CIRCUIT AND LIQUID CRYSTAL DISPLAY DEVICE

(75) Inventors: Yasuyuki Kudo, Kamakura (JP); Yoshikazu Yokota, Kodaira (JP); Kazunari Kurokawa, Mobara (JP); Atsuhiro Higa, Yokohama (JP)

(73) Assignee: Hitachi, Ltd., Tokyo (JP)

( * ) Notice: Subject to any disclaimer, the term of this patent is extended or adjusted under 35 U.S.C. 154(b) by 49 days.

(21) Appl. No.: 09/930,311

(22) Filed: Aug. 16, 2001

(65) Prior Publication Data

US 2002/0109653 A1 Aug. 15, 2002

(30) Foreign Application Priority Data

Feb. 14, 2001 (JP) ..... 2001-036303

(51) Int. Cl.[7] ..... G09G 3/36
(52) U.S. Cl. ..... 345/87; 345/96
(58) Field of Search ..... 345/87–100, 204–206, 345/258, 209

(56) References Cited

U.S. PATENT DOCUMENTS 5,448,384 A * 9/1995 Uchino et al. ..... 349/33
5,774,099 A * 6/1998 Iwasaki et al. ..... 345/87
5,852,426 A * 12/1998 Erhart et al. ..... 345/96
5,929,847 A * 7/1999 Yanagi et al. ..... 345/204
6,172,663 B1 * 1/2001 Okada et al. ..... 345/96

FOREIGN PATENT DOCUMENTS

JP 11-326863 11/1999

* cited by examiner

*Primary Examiner*—Alexander Eisen
(74) *Attorney, Agent, or Firm*—Antonelli, Terry, Stout & Kraus, LLP

(57) ABSTRACT

A matrix type liquid crystal display device has a function of suppressing power consumption without calling for an extra circuit arrangement such as the arrangement of storage capacitance and wiring to storage capacitance and without disposing new external components. A switch is disposed in the liquid crystal display device to temporarily short-circuit both column electrodes and common electrodes sandwiching a liquid crystal between them in synchronism with an alternation timing.

10 Claims, 20 Drawing Sheets

FIG. 6

| LDATA | M | VD | |
|---|---|---|---|
| | | NW MODE LIQUID CRYSTAL | NB MODE LIQUID CRYSTAL |
| BLACK 000000 | HIGH | LOW POTENTIAL V0 | HIGH POTENTIAL V63 |
| 000001 | | V1 | V62 |
| 000010 | | V2 | V61 |
| 000011 | | V3 | V60 |
| 000100 | | V4 | V59 |
| 000101 | | V5 | V58 |
| 000110 | | V6 | V57 |
| ⋮ | | ⋮ | ⋮ |
| 111101 | | V61 | V2 |
| 111110 | | V62 | V1 |
| WHITE 111111 | | HIGH POTENTIAL V63 | LOW POTENTIAL V0 |
| BLACK 000000 | LOW | HIGH POTENTIAL V63 | LOW POTENTIAL V0 |
| 000001 | | V62 | V1 |
| 000010 | | V61 | V2 |
| 000011 | | V60 | V3 |
| 000100 | | V59 | V4 |
| 000101 | | V58 | V5 |
| 000110 | | V57 | V6 |
| ⋮ | | ⋮ | ⋮ |
| 111101 | | V2 | V61 |
| 111110 | | V1 | V62 |
| WHITE 111111 | | LOW POTENTIAL V0 | HIGH POTENTIAL V63 |

NW MODE LIQUID CRYSTAL:
LIQUID CRYSTAL DISPLAYING WHITE AT NON-APPLICATION OF VOLTAGE
NB MODE LIQUID CRYSTAL:
LIQUID CRYSTAL DISPLAYING BLACK AT NON-APPLICATION OF VOLTAGE

| SIGNAL NAME | MEANING | "Low" | "High" |
|---|---|---|---|
| CS | CHIP SELECTION | ACCESSIBLE | NOT ACCESSIBLE |
| RS | REGISTER ADDRESS / DATA SELECTION | ADDRESS | DATA |
| E | ENABLING OF DATA WRITE / READ | DISABLE | ENABLE |
| RW | SELECTION OF DATA WRITE / READ | WRITE | READ |
| D | BI-DIRECTIONAL DATA | – | – |

LIQUID CRYSTAL DRIVER CIRCUIT AND LIQUID CRYSTAL DISPLAY DEVICE

BACKGROUND OF THE INVENTION

This invention relates to a technology for achieving lower power consumption in an active matrix type liquid crystal display device.

To prevent degradation of a liquid crystal, a matrix type liquid crystal display device for controlling a transmission factor (brightness) of each pixel at an effective value of an applied voltage has to employ so-called "alternation" in which the polarity of the applied voltage to the liquid crystal is inversed in a predetermined cycle. Since the liquid crystal is made of a dielectric in this instance, charging and discharging of the liquid crystal consume power in the alternation process described above.

U.S. Pat. No. 5,852,426 describes a method of reducing this power consumption. In this method, a switch is provided to change connection of liquid crystal driving electrodes to a liquid crystal driver circuit or to external storage capacitance. The switch selects the external storage capacitance in the first period of one scanning cycle and the liquid crystal driver circuit in the second period. When the external storage capacitance is sufficiently large, the driving voltage can be shifted to a substantial midpoint of the AC amplitude in the first period without consuming power. In consequence, power consumption can be reduced much more than when no means is employed.

U.S. Pat. No. 5,852,426 needs disposition of the storage capacitance outside the liquid crystal driver circuit. Therefore, to employ this method, a new circuit board design such as the arrangement of the storage capacitance and wiring to the storage capacitance becomes necessary, and the number of components increases, too.

SUMMARY OF THE INVENTION

It is an object of the present invention to provide a matrix type liquid crystal display device, and a driving method thereof, that can save power consumption resulting from alternation without disposing outside any component.

The present invention for solving the problem described above is based on the concept that a charge stored in a liquid crystal can be initialized to 0 (or substantially 0) when an A electrode and a B electrode sandwiching a liquid crystal between them are temporarily short-circuited at a timing of alternation as shown in FIG. 1. In other words, the sequence having this short-circuit can shift the voltage to a substantial midpoint of alternation amplitude without consuming power. This means that the power-saving effect can be obtained in the same way as in U.S. Pat. No. 5,852,426 without involving the disposition of external components.

The liquid crystal display controller and the liquid crystal display device according to the present invention based on this concept provide switch means for temporarily short-circuiting both of column electrodes and common electrodes sandwiching a liquid crystal in synchronism with the timing of alternation to these electrodes. The present invention includes also means for setting a charge stored in the liquid crystal to or below a predetermined value in synchronism with the timing of alternation. The predetermined value includes 0 (or substantially 0).

BRIEF DESCRIPTION OF THE DRAWINGS

FIG. 6 is a table useful for explaining the operation of a column voltage generation unit in the first embodiment of the present invention;

DESCRIPTION OF THE EMBODIMENTS

Figure 1:
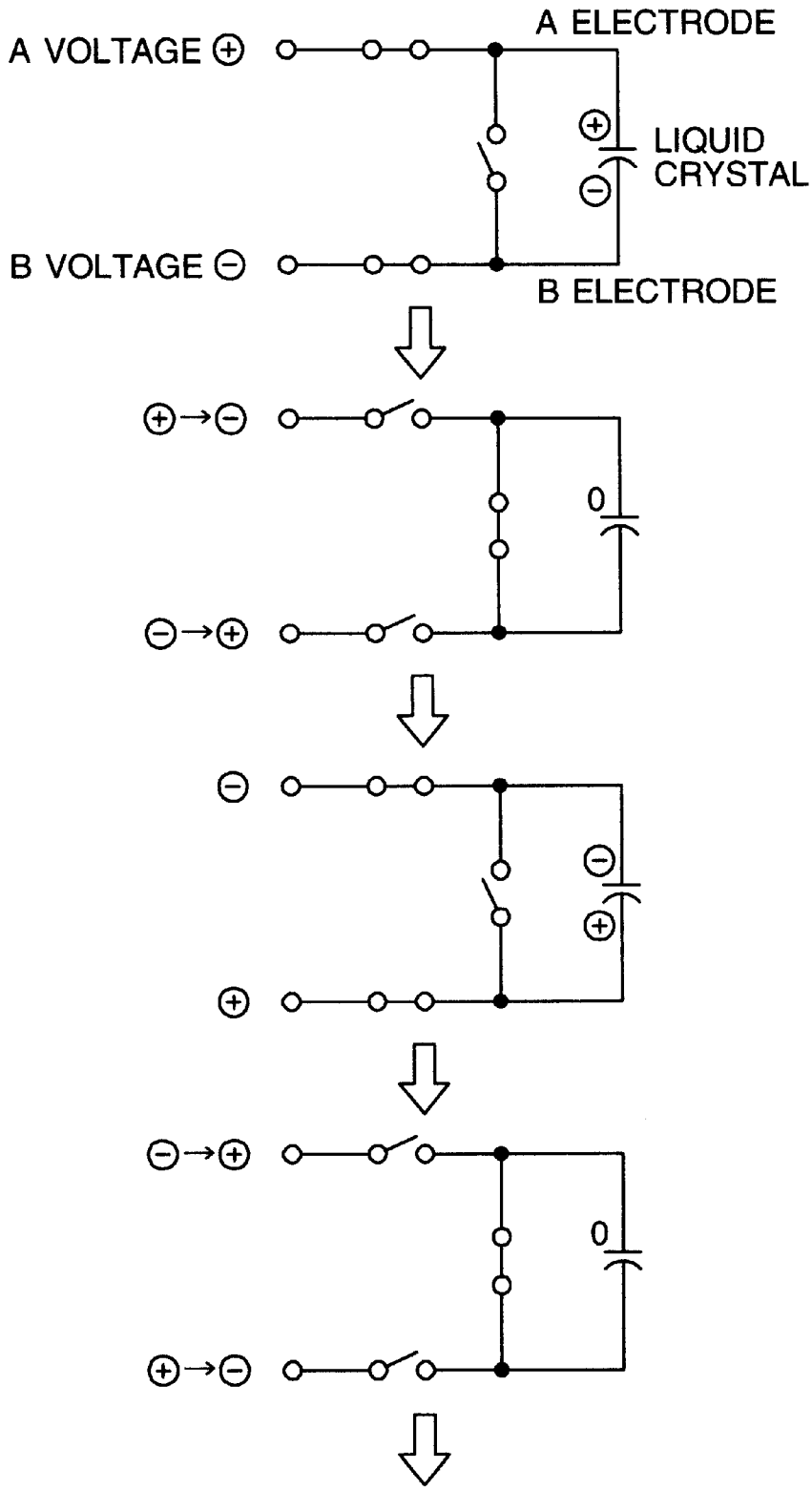
FIG. 1 is a circuit model of a liquid crystal that represents the concept of the present invention.
Figure 2:
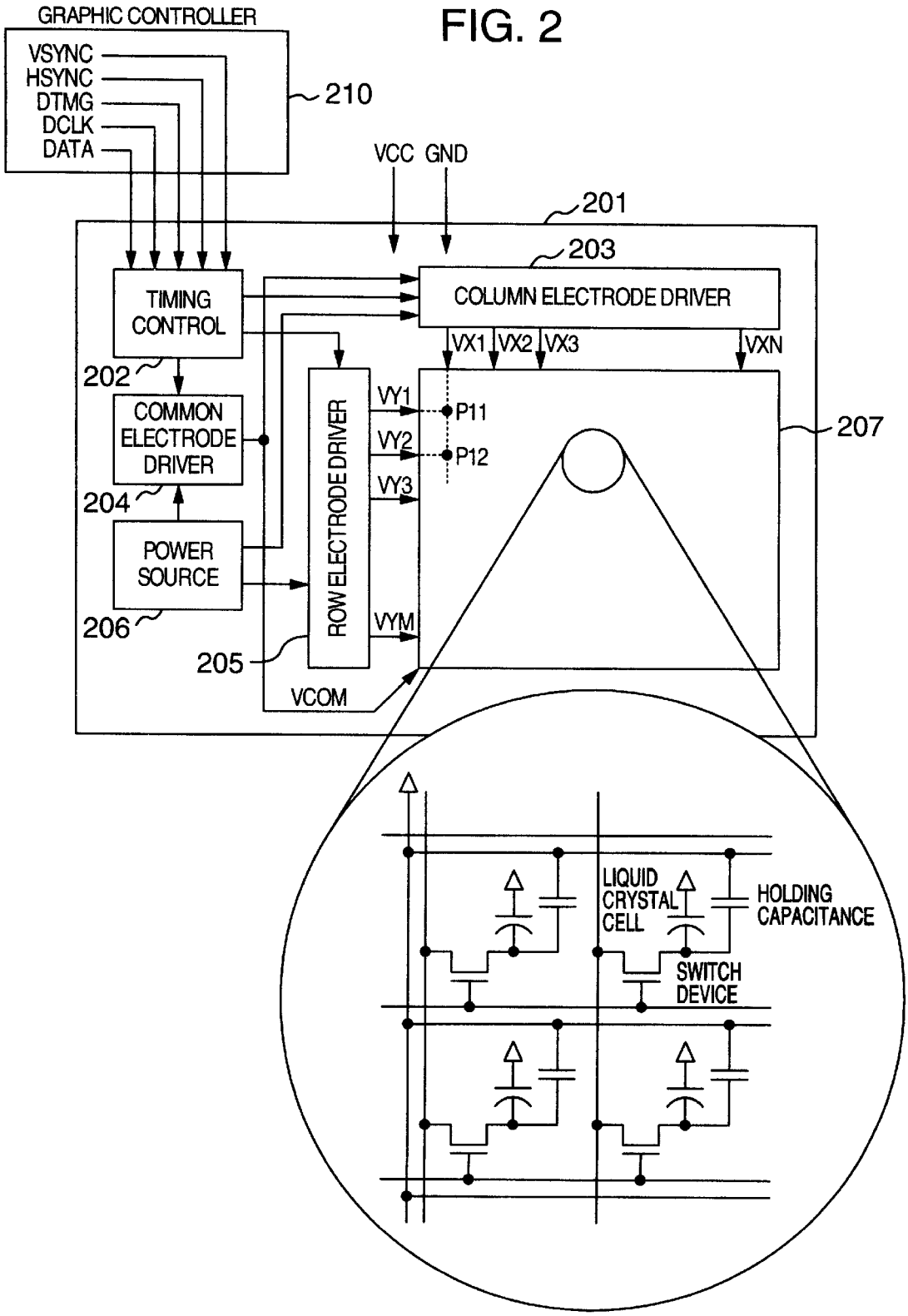
FIG. 2 is a block diagram showing a construction of a liquid crystal display device according to the first embodiment of the present invention.

Initially, the first embodiment of the present invention will be explained with reference to FIGS. 2 to 9. FIG. 2 shows a construction of a liquid crystal display device according to the first embodiment. Referring to FIG. 2, reference numeral 201 denotes the liquid crystal display device according to the present invention. Numeral 202 denotes a timing control unit. Numeral 203 denotes a column electrode driver unit. Numeral 204 denotes a common electrode driver unit. Numeral 205 denotes a column electrode driver unit. A 3-terminal switch device, a liquid crystal cell and a holding capacitance are arranged at a position corresponding to each pixel of a pixel unit 207. A drain terminal of the switch device is connected to a column electrode. Its gate terminal is connected to a row electrode and its source terminal, to the liquid crystal cell and the holding capacitance. The other terminal of the liquid crystal cell is connected to a common opposing electrode. The other terminal of the holding capacitance is connected to a common storage electrode. A common electrode driver unit 204 drives both of them. To achieve this connection, the column electrode, the row electrode and the storage electrode are formed in a matrix shape on the inner surface of one of the two transparent substrates that sandwich the liquid crystal between them. The common electrode is formed in a mat shape on the inner surface of the other transparent electrode.

Next, the operation of each block will be explained about the case where so-called "Vcom modulation drive", in which the applied voltage to the common electrode is allowed to modulate, is conducted by way of example on the assumption that the liquid crystal display device 201 is scanned by a line sequential scanning system.

Figure 3:
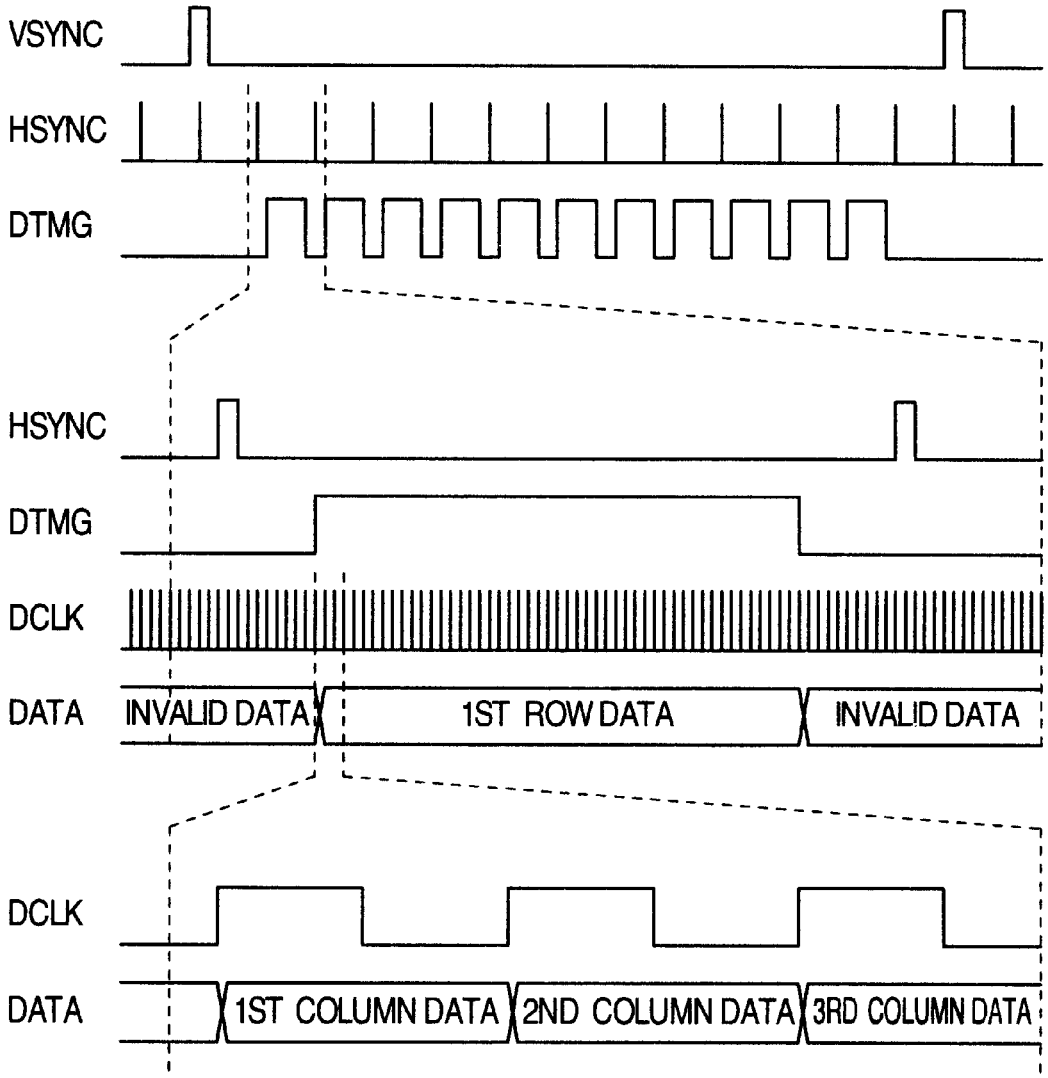
FIG. 3 is a timing chart showing input signals for timing control in the first embodiment of the present invention.

First, the timing control unit 202 receives a group of standard image input signals in a matrix type liquid crystal using a switch device (hereinafter called merely the "active matrix type liquid crystal") from an external graphic controller 210. FIG. 3 shows a timing chart of the signal group. From the signal group FLM, the timing control unit 202 generates FLM representing a scanning start timing of a front scanning line, CL1 representing a voltage application start timing to the column electrode and to the common electrode, EN representing a transfer period of effective display data for one scanning line, M representing the polarity of alternation, SHT representing an execution timing of short-circuiting, CL3 representing a voltage application start timing to the row electrode, CL2 representing a transfer clock of display data of each column in one scanning line and DT representing display data for one scanning line. The timing control unit 202 outputs these signals to the column electrode driver unit 203, the common electrode driver unit 204 and the row electrode driver unit 205. In this embodiment, DT is assumed to have 64 gray-scale information or 6 bits per pixel.

Figure 5:
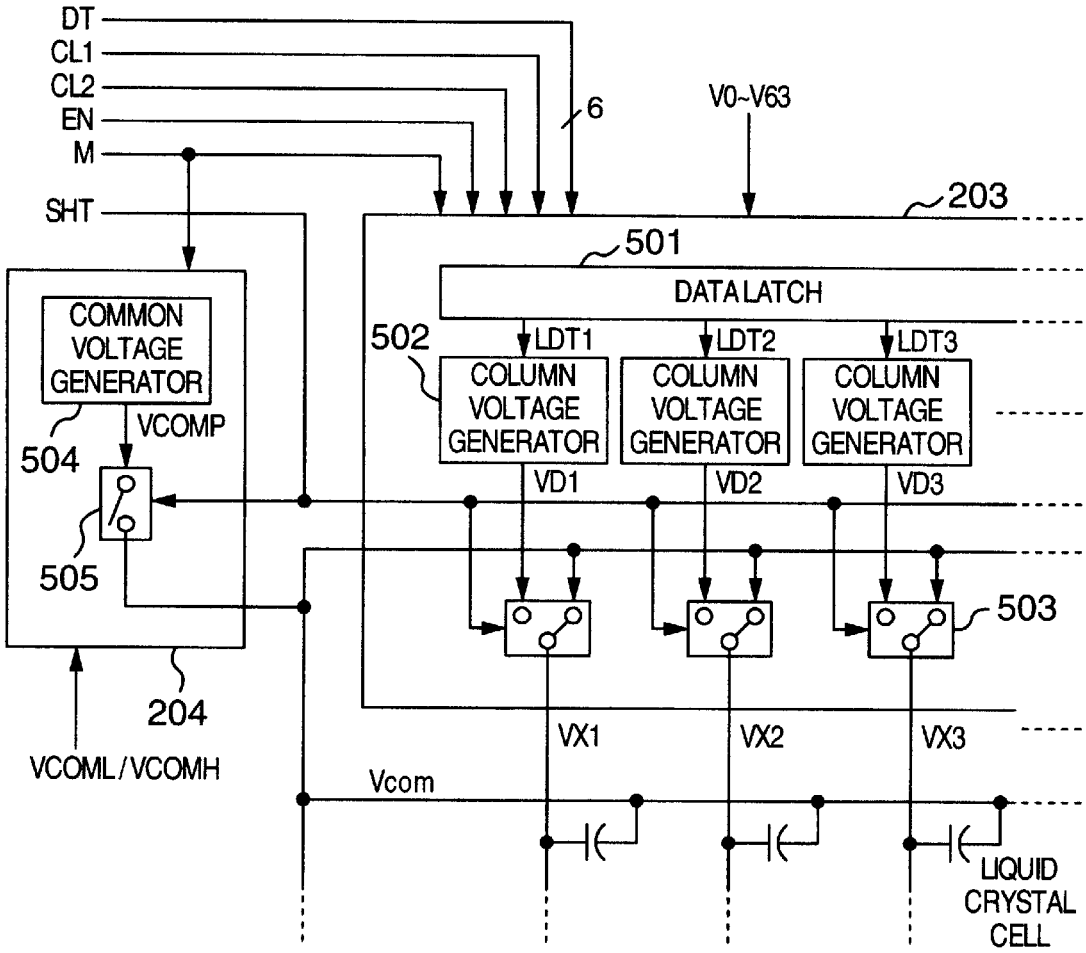
FIG. 5 is a block diagram showing a column electrode driver unit and a common electrode driver unit in the first embodiment of the present invention.

Next, FIG. 5 shows an internal construction of the column electrode driver unit 203 and the common electrode driver unit 204. In FIG. 5, reference numeral 501 denotes a data latch circuit. Numeral 502 denotes a column voltage generation circuit. Numeral 503 denotes a short-circuit switch A. Numeral 504 denotes a common voltage generation circuit. Numeral 505 denotes a short-circuit switch B. Inputs of the column electrode driver unit 203 are DATA, CL1, CL2, EN, M, SHT and column voltages V0 to V63 corresponding to 64 gray scales. Inputs of the common electrode driver unit 204 are M and VCOMH and VCOML (two kinds of voltage are necessary for alternation) as reference voltages of the common voltage. Incidentally, a power source circuit 206 generates the voltage level of each of V0 to V63, VCOMH and VCOML on the basis of a VCC voltage inputted from outside. The mutual relation of each voltage level has the same setting as that of ordinary Vcom modulation drive, and the voltage is set to an optimal value in accordance with applied voltage-v-transmission factor characteristics of the liquid crystal.

First, in the column electrode driver unit 203, the data latch circuit 501 stores DT for one row (one scanning line) in the High period of EN by use of CL2 and repeats the operation of outputting altogether the data stored as LDT1 to LDTn (hereinafter called generically "LDT") in synchronism with CL1. The column voltage generation circuit 502 selects one of the column voltages V0 to V63 corresponding to the gray scale of the pixel in accordance with LDT of each column and the signal M and outputs it as VD (generically representing one of VD1 to VDn). FIG. 6 shows an example of this selection operation.

The short-circuit switch A503 is a switch that selects either one of the terminal from the column voltage generation circuit 502 and the terminal from the common electrode in accordance with the signal SHT. It selects the common electrode when the signal SHT is High and the terminal of the column voltage generation circuit when the signal SHT is Low. The short-circuit switch A503 outputs VX (generically representing VX1 to VXn) to the respective column electrode.

Next, in the common electrode driver unit 204, the common voltage generation circuit 504 selects VCOMH when the input signal M is High and VCOML when the signal M is Low, and outputs the selected signal as VCOMP. The short-circuit switch B505 is a switch that selects whether or not the terminal from the common voltage generation circuit 504 is to be as such connected, in accordance with the signal SHT. The common voltage generation circuit 504 cuts off the connection when the signal SHT is High, connects the terminal when the signal is Low, and outputs the signal as VCOM to the common electrode and to the storage electrode.

Figure 7:
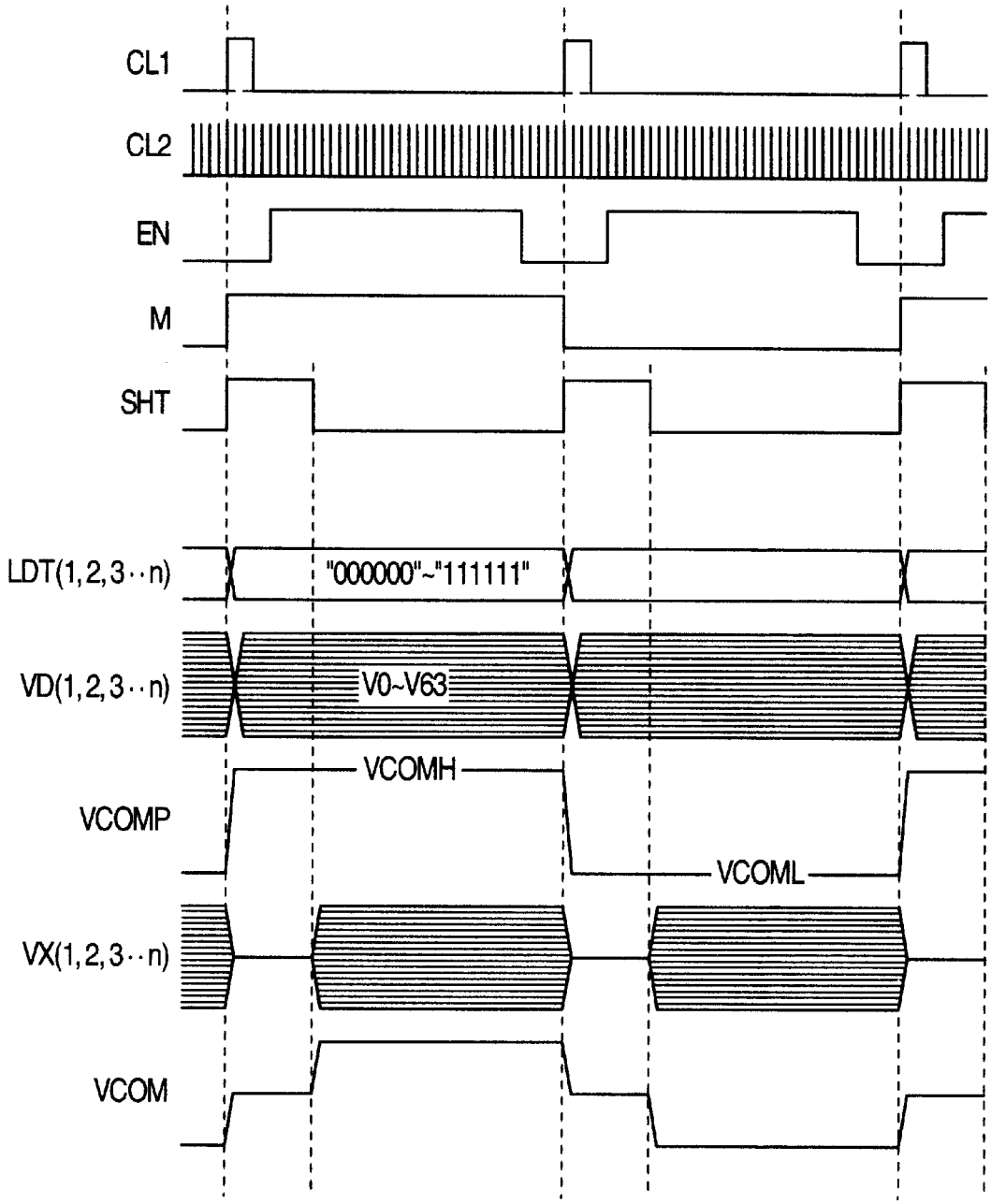
FIG. 7 is a timing chart showing operations of the column electrode driver unit and the common electrode driver unit in the first embodiment of the present invention.

FIG. 7 shows altogether the timing chart of the operations described above. As can be appreciated from FIG. 7, VX and VCOM are short-circuited and reach a certain equal potential level when SHT is High, are released from short-circuit when SHT falls thereafter to Low, and execute the ordinary driving operation. This is equal to the above-mentioned operation of saving power consumption.

Figure 8:
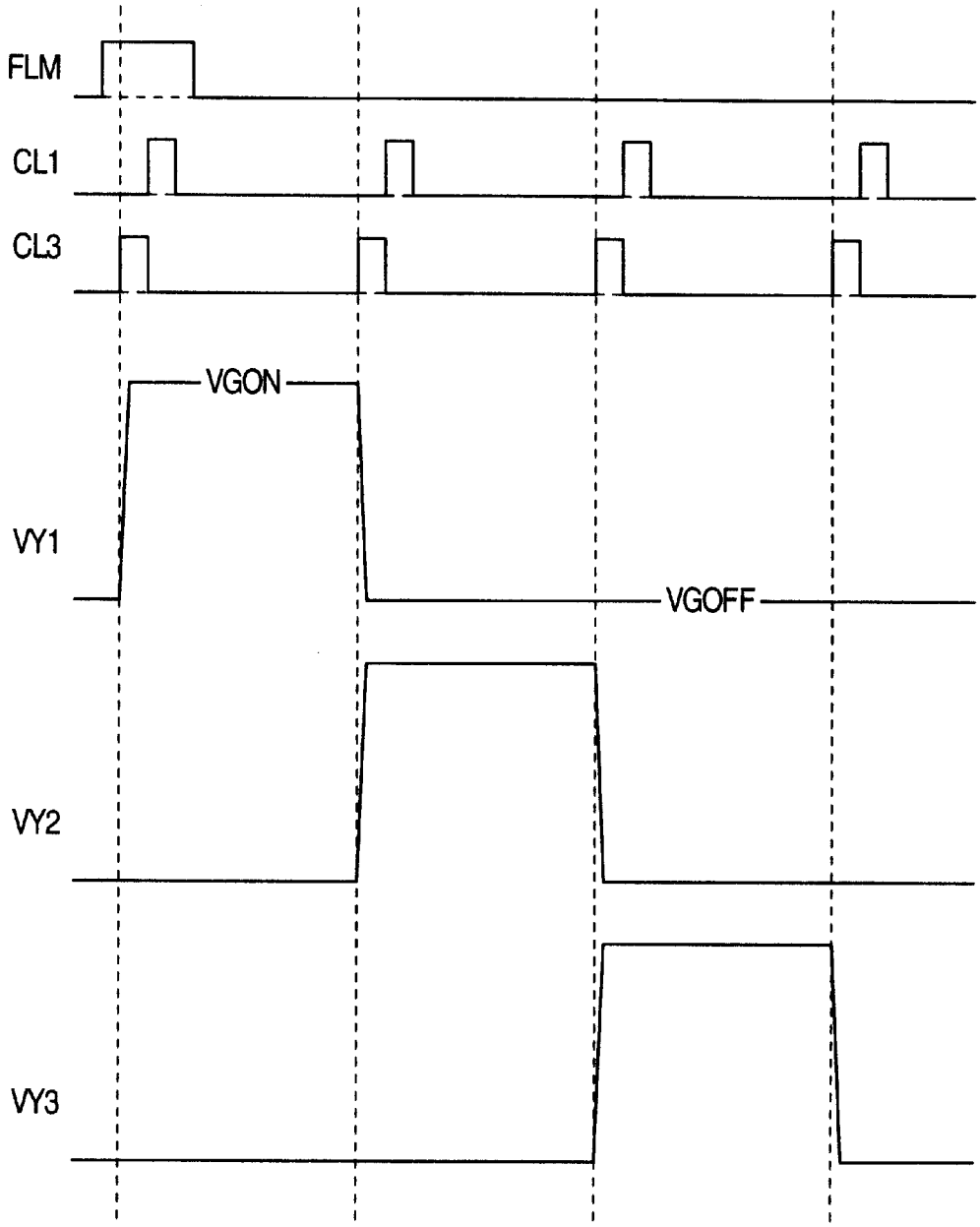
FIG. 8 is a timing chart showing the operation of a row electrode driver unit in the first embodiment of the present invention.

Next, the operation of the row electrode driver portion 205 will be explained with reference to FIGS. 2 and 8. First, inputs of the row electrode driver unit 205 are FLM, CL3 and VGON and VGOF as the reference voltages of the row voltage. Incidentally, the power source circuit 206 generates VGON and VGOFF on the basis of the VCC voltage that is inputted from outside. VGON has a voltage level at which the gate of the transistor connected to the row electrode is turned ON and VGOFF has a voltage level at which the gate is turned OFF. As shown in the timing chart of FIG. 8, the row electrode driver unit 205 acquires High of FLM at the rise of CL3, sequentially shifts this FLM in synchronism with CL3 and outputs it as VY to the row electrode to sequentially shift the scanning line. This operation can be achieved by use of shift registers, for example.

In the liquid crystal display device shown in FIG. 2, for example, let's consider the liquid crystal applied voltages VLC11 and VLC12 at an intersection P11 where the column to which VX1 is applied intersects the row to which VY1 is applied, and at an intersection P12 where VX1 and VY2 intersect each other. It will be assumed hereby that the display data of P11 and P12 are (111111) and (100000) and the mode of the liquid crystal is the NB mode in FIG. 6.

Figure 9:
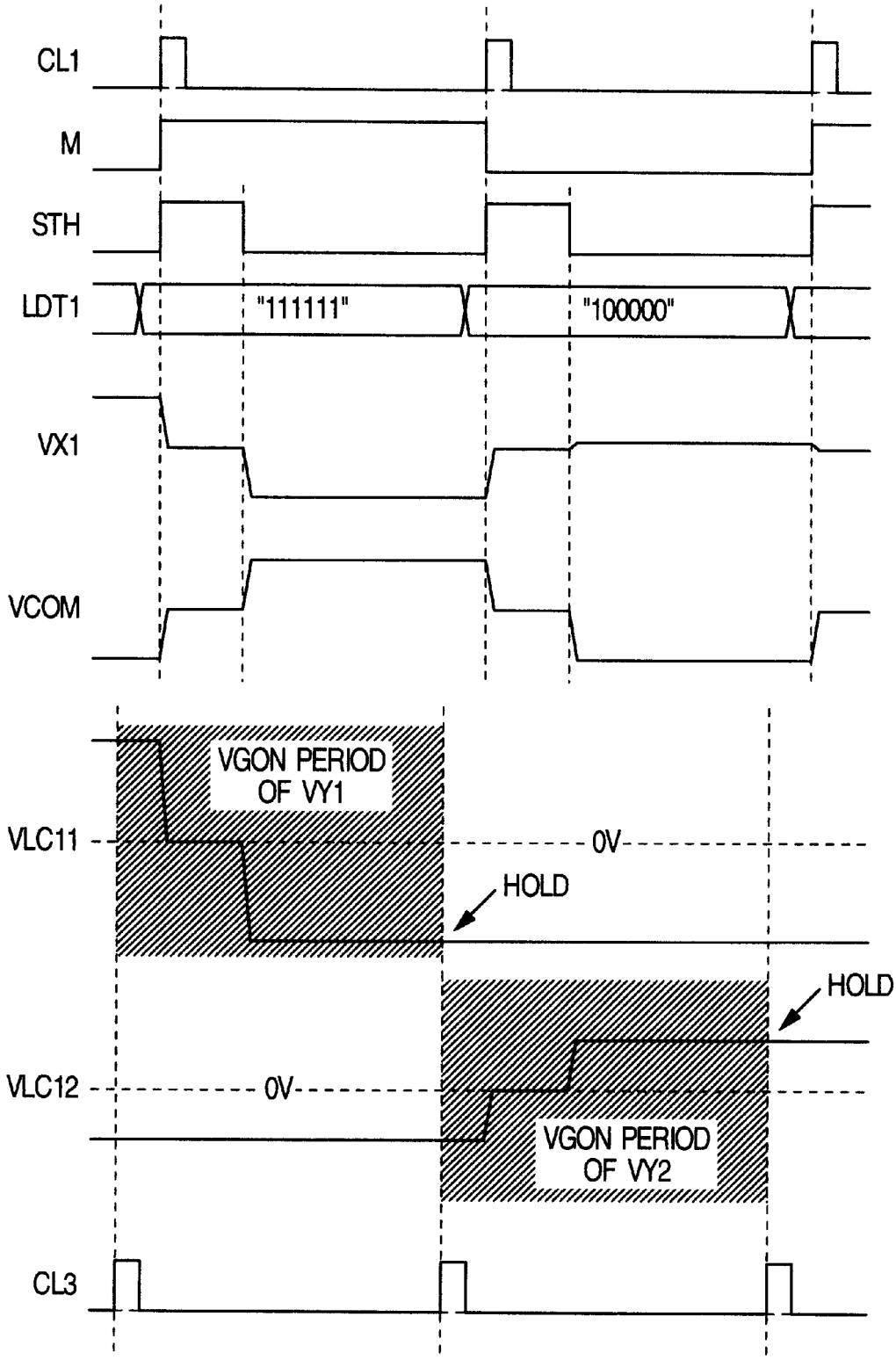
FIG. 9 is a timing chart showing a liquid crystal applied voltage in the first embodiment of the present invention.

FIG. 9 shows the applied voltage waveforms of VLC11 and VLC12. As can be seen from FIG. 9, after a difference voltage between VCOM and VX1 is applied during the VGON period of VLC11 and VLC12, the voltages at the end of the VGON period are held. Since the voltages at this time have the voltage levels corresponding to the display data, display can be accomplished in the same way as ordinary Vcom modulation drive.

Incidentally, the switching period of M is one scanning cycle in this embodiment. However, the switching period is not particularly limited but may be a plurality of scanning cycles. In such a case, it is preferred that SHT outputs High and Low for only the first one scanning period after switching of M and remains Low in other periods.

Next, the second embodiment of the present invention will be explained with reference to FIGS. 10 to 13. The second embodiment of the present invention represents an application example of the present invention to a liquid crystal display controller of a display memory built-in type.

Figure 10:
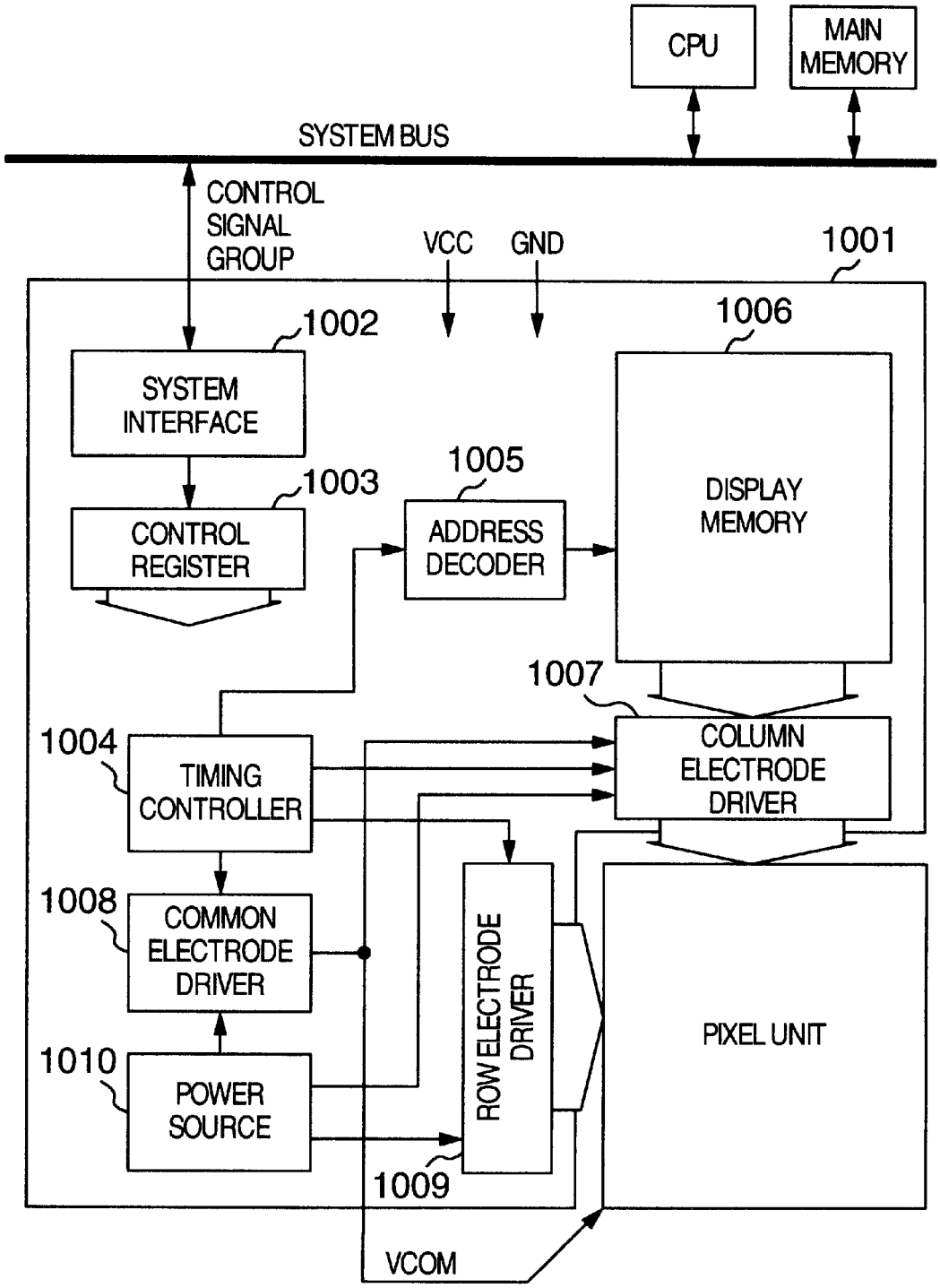
FIG. 10 is a block diagram showing a construction of a liquid crystal display controller according to the second embodiment of the present invention.

Referring to FIG. 10, reference numeral 1001 denotes a liquid crystal display controller. Numeral 1002 denotes a system interface. Numeral 1003 denotes a control register. Numeral 1004 denotes a timing generation unit. Numeral 1005 denotes an address decoder. Numeral 1006 denotes a display memory. Numeral 1007 denotes a column electrode driver unit. Numeral 1008 denotes a common electrode driver unit. Numeral 1009 denotes a row electrode driver unit. Numeral 1010 denotes a power source circuit. Numeral 1011 denotes a pixel unit comprising a plurality of pixels that are arranged in matrix.

Figures 11, 12:
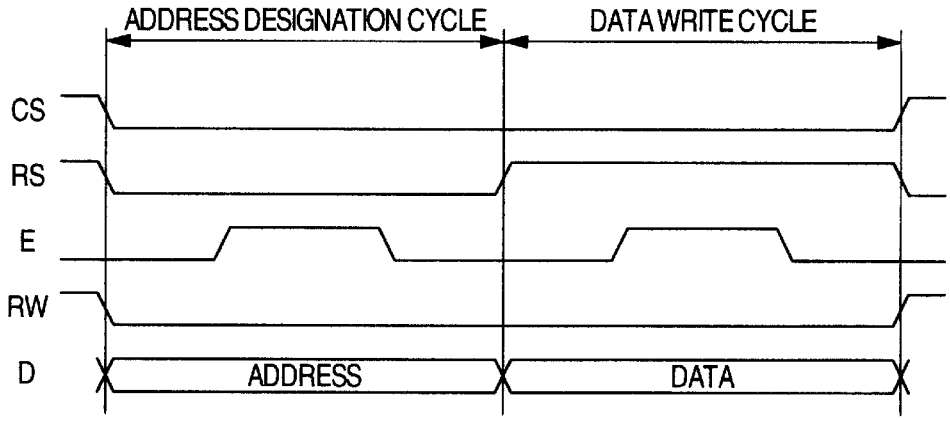
FIG. 11 is an explanatory view of input signals of a system interface in the second embodiment of the present invention.
FIG. 12 is a timing chart showing the operation of the input signals of the system interface in the second embodiment of the present invention.

First, the interface of the liquid crystal display controller is based on a so-called "MPU6800 Series" bus interface, for example. As shown in FIG. 11, CS representing chip selection, RS for selecting the address/data of the control register, E designating the enabling of the operation, RW for selecting write/read of the data and D as the actual value of the address/data are given as signals through a system bus. These control signals have a cycle for designating the address of the control register and a cycle for writing the data. The operations of the control signals in these cycles will be explained with reference to FIG. 12. In the address designation cycle, CS is set to "Low", RS, to "Low", RW, to "Low" and D, to a predetermined address value. Thereafter, E is set to "High" for a predetermined period. In the data write cycle, on the other hand, CS is set to "Low", RS, to "High", RW, to "Low" and D, to a desired data. Thereafter, E is set to "High" for a predetermined period. Incidentally, these operations are programmed in advance by an operating system and application software for controlling the overall apparatus.

The system interface 1002 is the portion that decodes the control signals described above. The system interface 1002 outputs the signal for bringing the corresponding address into the write state in the address designation cycle to the control register 1003 and a data to be written in the data write cycle to the control register 1003.

The control register 1003 brings the register having the designated address into the write state and stores the data in this register. Incidentally, the data to be written into the control register 1003 are various driving parameters such as resolution of the liquid crystal panel, the display data and the display position data. These data are written to separate addresses, respectively. The driving parameters stored in the control registers 1003 are outputted to each block, and the display data is outputted to the display memory 1006.

Figure 4:
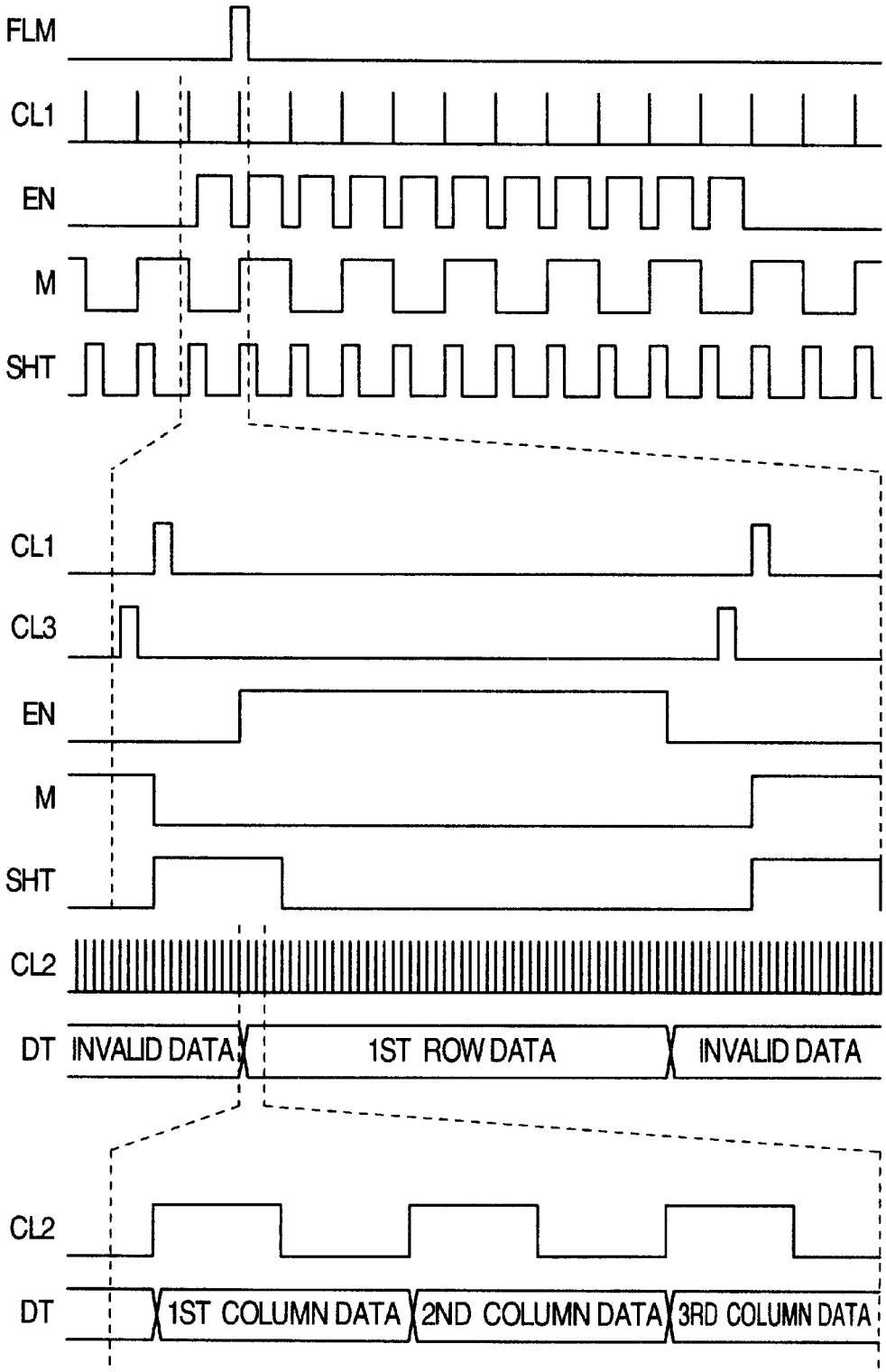
FIG. 4 is a timing chart showing output signals for timing control in the first embodiment of the present invention.

The timing generation unit 1004 is a portion that generates by itself the timing signal group on the basis of the driving parameters given from the control register 1003, and its content is substantially equal to the timing signal group shown in FIG. 4. At the same time, the timing generation unit 1004 generates a read address of the display memory and outputs it to the address decoder 1005.

The address decoder 1005 decodes the display position data given from the control register 1003 at the time of write of the display data and selects the bit line and the word line inside the corresponding display memory 1006. The address decoder 1005 then outputs the display data given from the control register 1003 to the data line of the display memory 1006 and completes the write operation. At the time of read-out, on the other hand, the address decoder 1005 decodes the read address outputted by the timing generation unit 1004 and selects the word line inside the corresponding display memory. Thereafter, the display data for one line is collectively outputted from the data line of the display memory 1006.

Incidentally, the read address described above is switched one line by line from the address at which the data of the leading line of the screen panel is stored, for example, and after the address of the final line, this operation is repeated while returning again to the leading line. The address switch timing of each line is in synchronism with CL1 and the timing for outputting the address of the leading line is in synchronism with FLM. The address decoder 1005 has a so-called "arbitration function" that assigns priority for either of the write operation and the read operation when they occur simultaneously.

The column electrode driver unit 1007 is the portion that converts the display data of each column of one line read out from the display memory 1006 to a predetermined column voltage, and selects and outputs either one of the voltage output and the terminal from the common electrode. This unit 1007 can be accomplished by use of the column voltage generation circuit in combination with the short-circuit switch in the same way as the column voltage driver circuit 203 of the first embodiment shown in FIG. 5.

The common electrode driver unit 1008 and the row electrode driver unit 1009 have the same construction and execute the same operation as those of the common electrode driver unit 204 and the row electrode driver unit 205 in the first embodiment. Therefore, the detailed explanation will be omitted. The timing generation unit 1004 and the power source circuit 1010 provide the input signal and the input voltage necessary for each block, respectively.

The operation of the liquid crystal display controller 1001 described above can accomplish the temporary short-circuit operation between the column electrode and the common electrode at the alternation timing as the feature of the present invention. Therefore, this embodiment can achieve lower power consumption in the same way as in the first embodiment.

Figure 13:
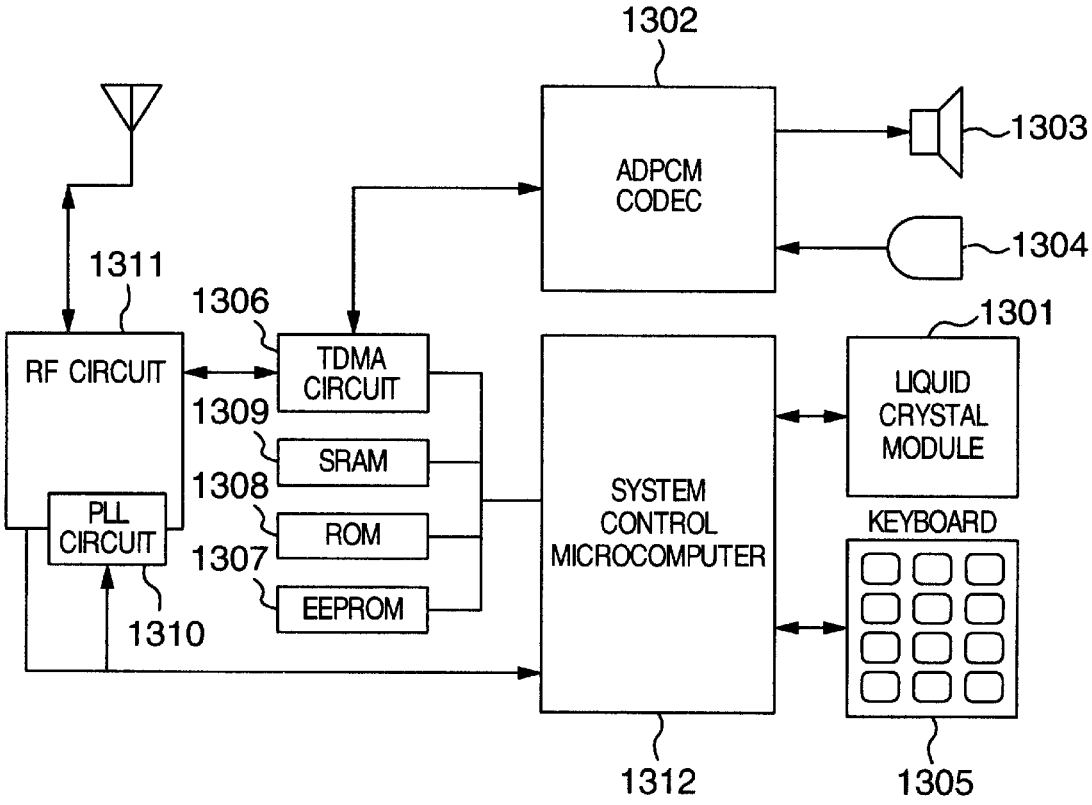
FIG. 13 is a block diagram showing a construction of a cellular telephone set in the second embodiment of the present invention.

The liquid crystal display controller 1001 according to the second embodiment can be applied to a cellular telephone set, for example. FIG. 13 shows a block construction of the cellular telephone set. Referring to FIG. 13, reference numeral 1301 denotes a liquid crystal module including the liquid crystal display controller of this invention and the pixel unit. Numeral 1302 denotes an ADPCM CODEC circuit for compressing/expanding speech. Numeral 1303 denotes a speaker. Numeral 1304 denotes a microphone. Numeral 1305 denotes a keyboard. Numeral 1306 denotes a TDMA circuit for time division multiplexing the digital data. Numeral 1307 denotes EEPROM for storing a registered ID number. Numeral 1308 denotes ROM for storing a program. Numeral 1309 denotes SRAM for temporarily storing the data and providing a work area of a microcomputer. Numeral 1310 denotes a PLL circuit for setting a carrier frequency of a wireless signal. Numeral 1311 denotes an RF circuit for transmitting and receiving the wireless signals. Numeral 1312 denotes a system controlling microcomputer. In FIG. 13, the aforementioned driving parameters and display data are given from the system controlling microcomputer 1312. These data are stored in ROM 1308 and SRAM 1309, respectively. The detailed explanation of each block will be hereby omitted, but the construction shown in FIG. 13 makes it possible to apply the liquid crystal display controller of the second embodiment to the cellular telephone unit.

Figure 14:
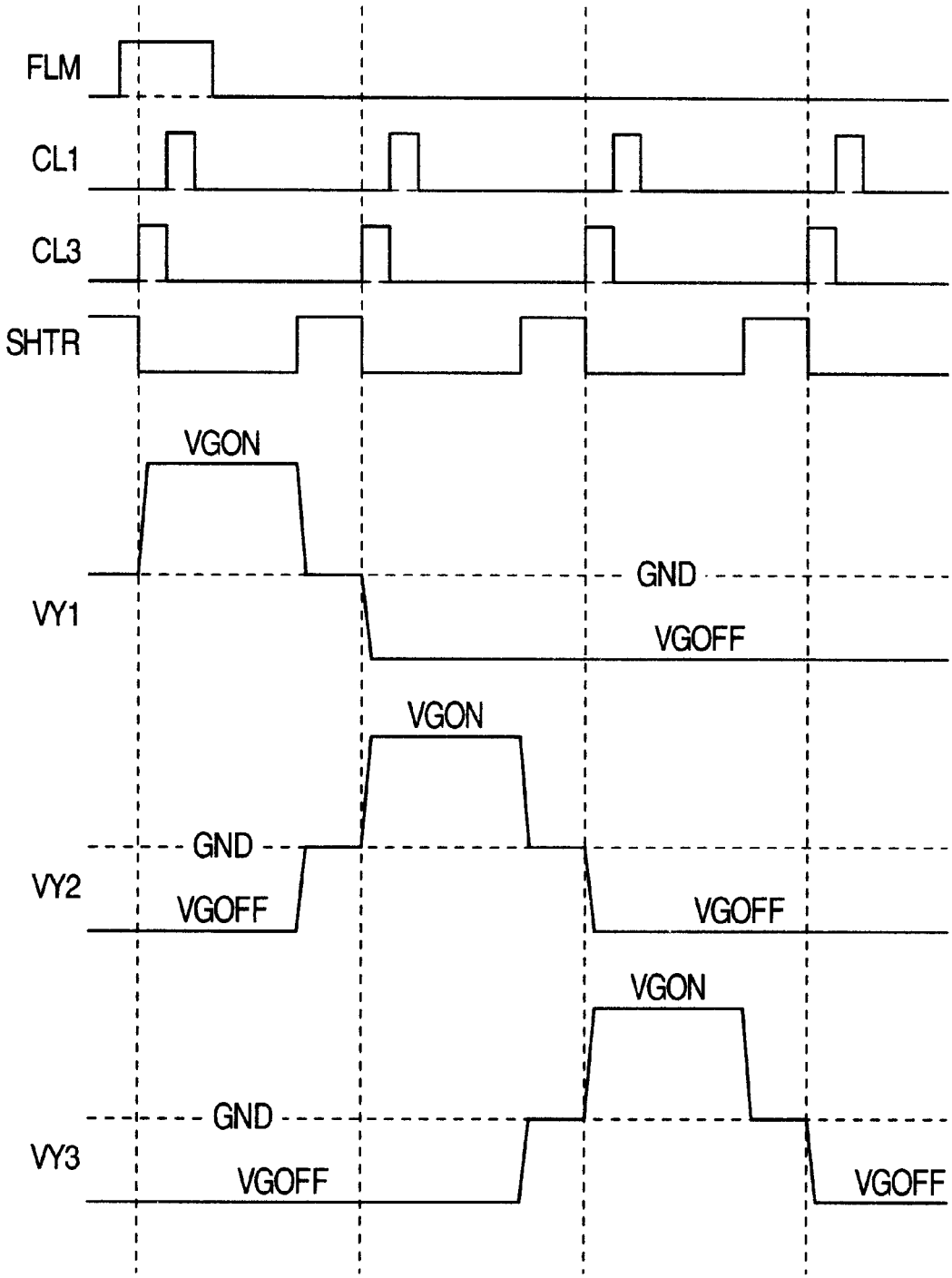
FIG. 14 is a timing chart showing the operation of a liquid crystal display device according to the third embodiment of the present invention.

Next, the third embodiment of the present invention will be explained with reference to FIGS. 14 to 16. To achieve lower power consumption at the row electrode driver unit, this embodiment contemplates to apply the short-circuit operation of the present invention. In the driving system of the ordinary active matrix type liquid crystal, the GON voltage shown in FIG. 8 is higher than GND and GOFF is lower than GND. If the row voltage is temporarily short-circuited to GND on the basis of this voltage relationship as shown in FIG. 14, power consumption with the voltage shift to GND does not exist, and power consumption of the row voltage driver unit can be reduced. Therefore, the construction of the row electrode driver unit and its construction for accomplishing this operation will be explained with reference to FIGS. 15 and 16.

Figure 15:
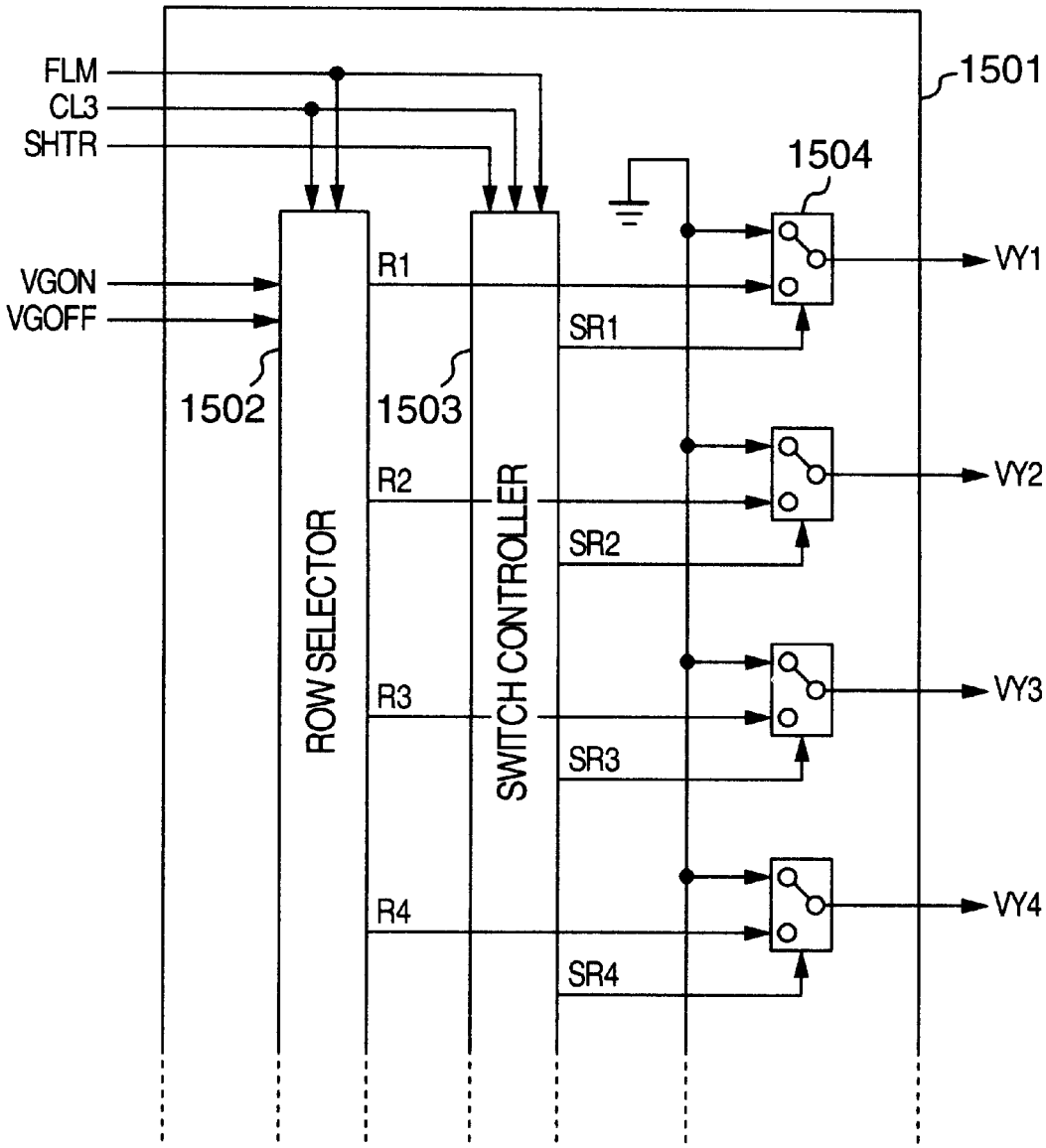
FIG. 15 is a block diagram showing a construction of a row electrode driver unit in the third embodiment of the present invention.
Figure 16:
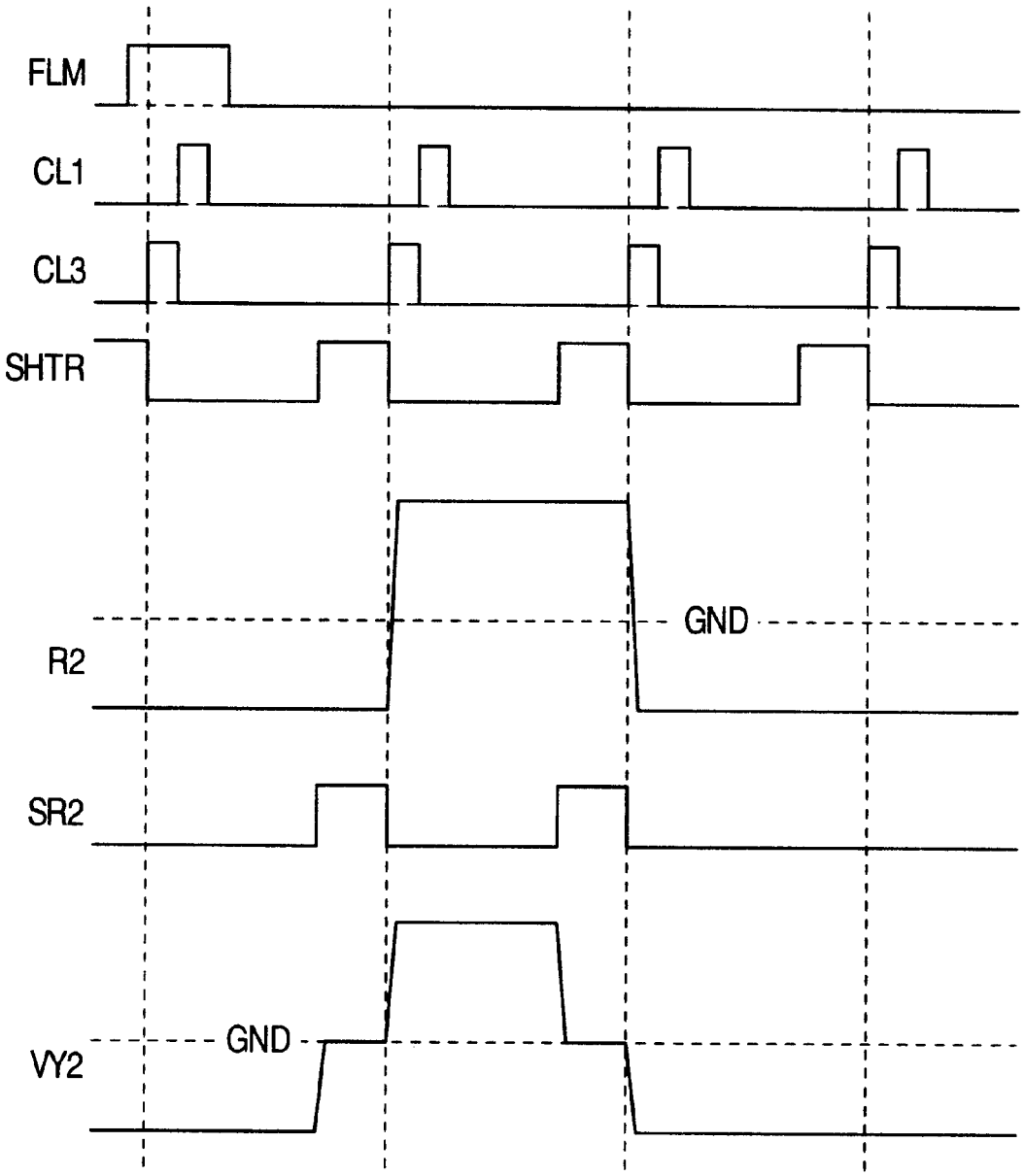
FIG. 16 is a timing chart showing the operation of the row electrode driver unit in the third embodiment of the present invention.

FIG. 15 shows the internal construction of the row electrode driver unit according to the third embodiment of the present invention. Numeral 1501 denotes the row electrode driver unit. Numeral 1502 denotes a row selection circuit. Numeral 1503 denotes a switch controlling circuit. Numeral 1504 denotes a short-circuit switch C. First, the row selection circuit 1502 is a portion that outputs VGON/VGOFF in the same way as the row electrode driver unit 205 in the first embodiment of the present invention. The row selection circuit 1502 acquires High of FLM at the rise of CL3, sequentially shifts the signal FLM in synchronism with CL3 and outputs the signal so shifted as R (generically representing R1 to Rm). The switch controlling circuit 1503 is a portion that controls the short-circuit switch C1504. Its inputs are FLM, CL3 and SHTR. The switch controlling circuit 1503 outputs as such SHTR during the scanning period in which VGON is applied to the row and during one previous period, and outputs Low in other periods. The short-circuit switch C1504 selects GND when the control signal SR (generically representing SR1 to SRm) outputted by the switch controlling circuit 1503 is High, selects the terminal from the row selection circuit 1502 when the control signal SR is Low and outputs VY (generically representing VY1 to VYm). FIG. 16 shows altogether the operation timing chart of the operation for VY2, by way of example. As can be appreciated from FIG. 16, the row electrode driver unit 1501 according to the third embodiment of the present invention can accomplish the operation shown in FIG. 14.

When combined with the first liquid crystal display device and the second liquid crystal display controller according to the present invention, the row electrode driver unit according to the third embodiment can further reduce power consumption.

Figure 17:
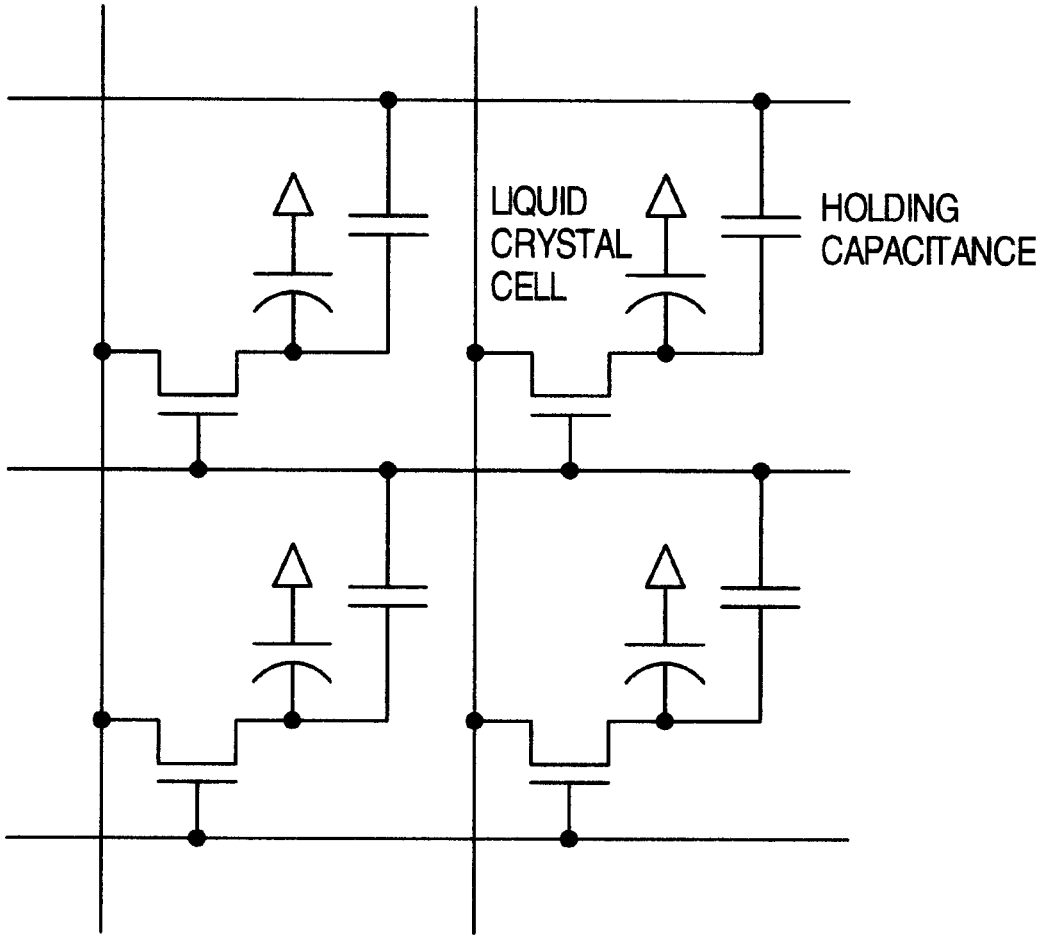
FIG. 17 shows a circuit model that represents a structure of pixels in the fourth embodiment of the present invention.
Figure 18:
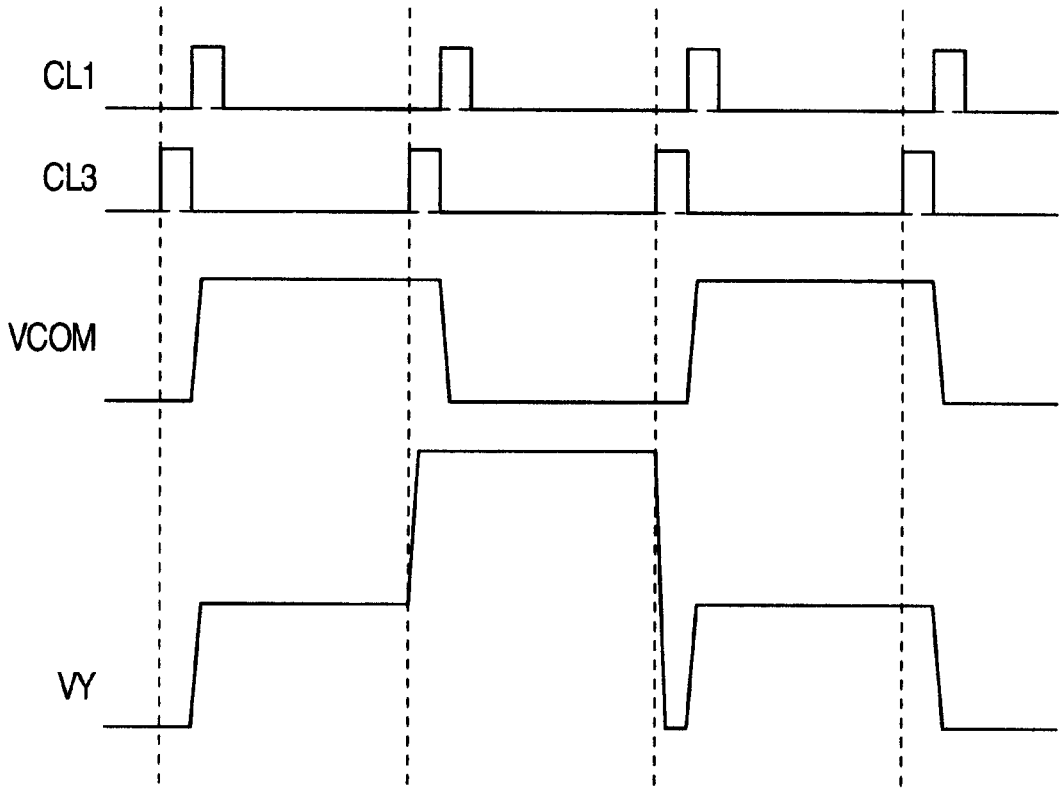
FIG. 18 is a timing chart showing an applied voltage to a pixel unit in the fourth embodiment of the present invention.
Figure 19:
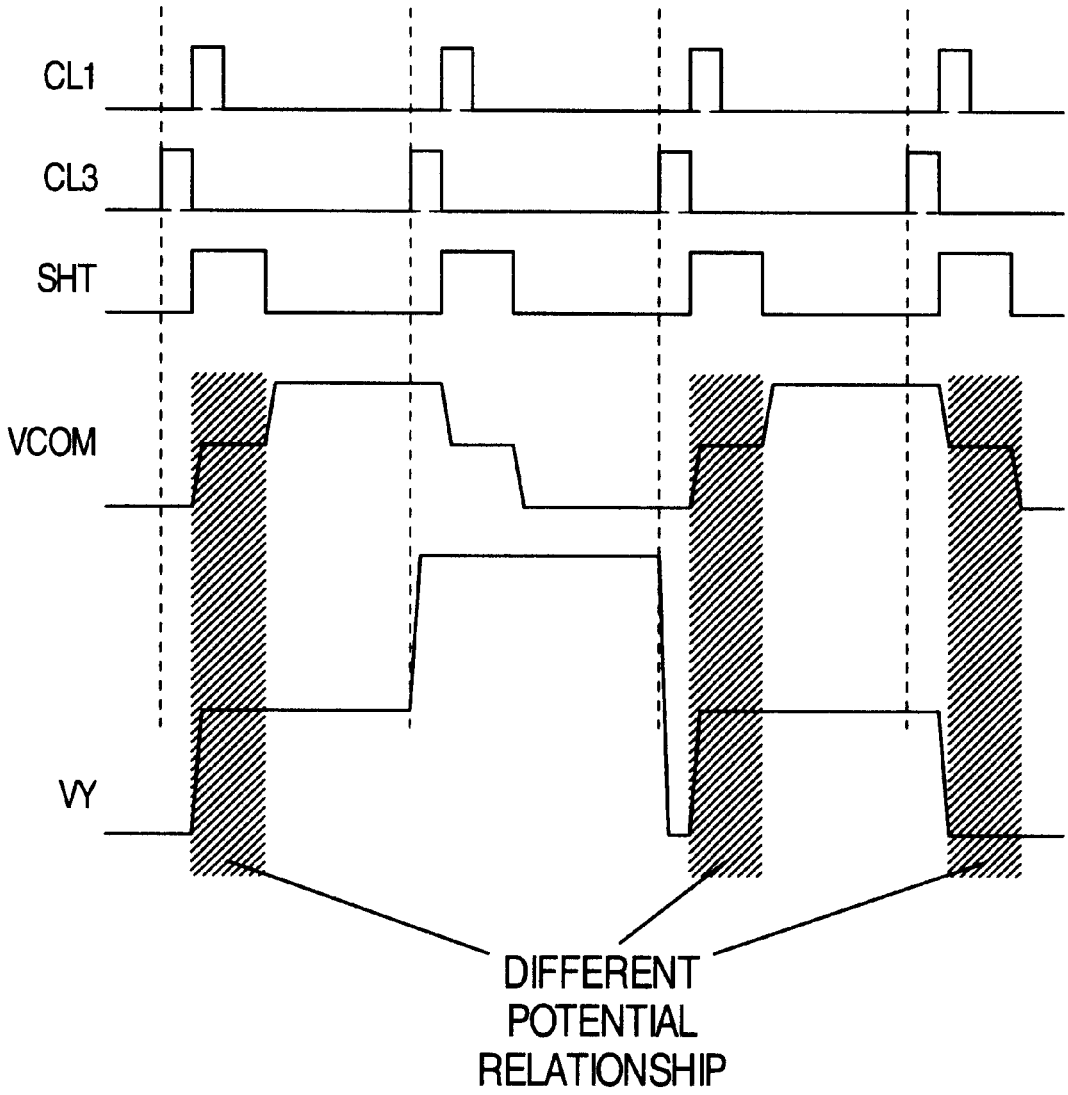
FIG. 19 is a timing chart showing the applied voltage to the pixel unit in the fourth embodiment of the present invention.
Figure 20:
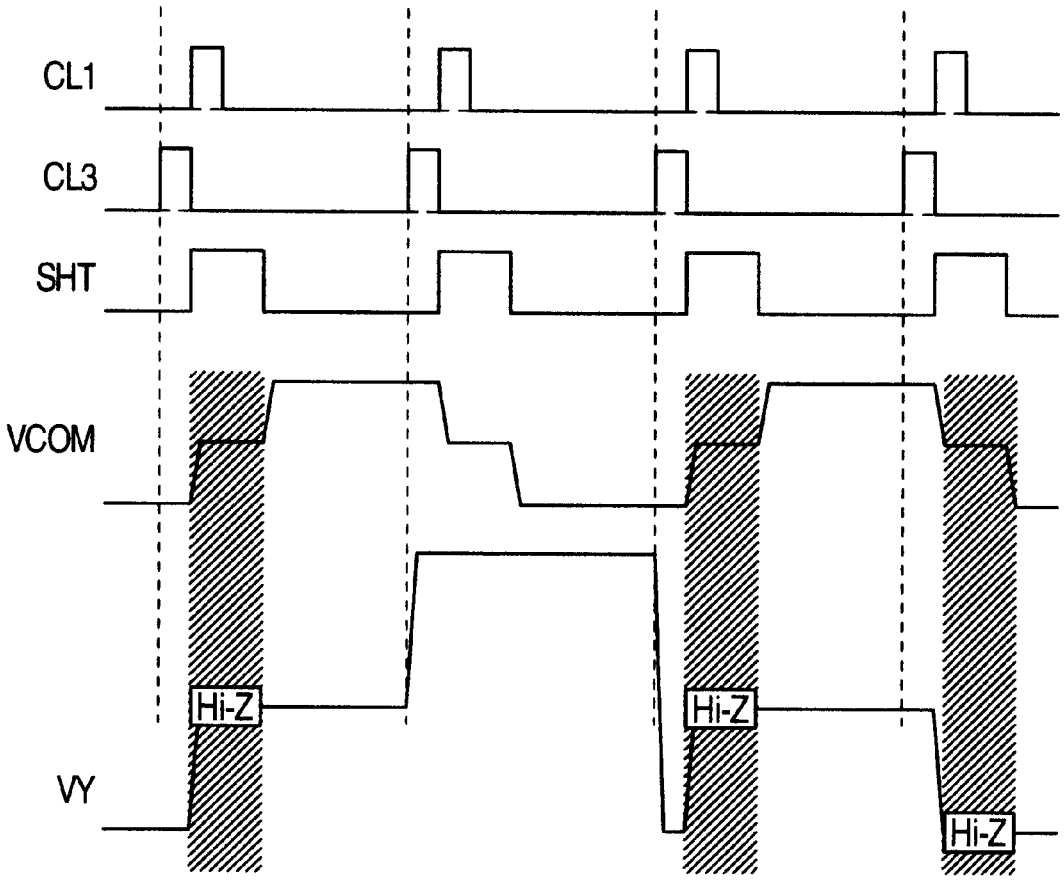
FIG. 20 is a timing chart showing the operation of a row electrode driver unit in the fourth embodiment of the present invention.

Next, the fourth embodiment of the present invention will be explained with reference to FIGS. 17 to 20. Besides the structure shown in FIG. 2, the structure in which the terminal of the holding capacitance is connected to a preceding row of a given row is known as the pixel structure of the active matrix type liquid crystal as shown in FIG. 17. When such a pixel structure is employed, it is customary to change the voltage waveform of GOFF in the same amplitude as that of the common voltage in order to keep the same potential relationship between the holding capacitance and the liquid crystal cell as shown in FIG. 18. When the short-circuit operation of the present invention is applied to this driving method, the potential relationship between VCOM and VY becomes different in the short-circuit period in which SHT is High as shown in FIG. 19. As a result, the charge stored in the holding capacitance migrates and power consumption increases. To solve this problem, the output of VY is brought into the high impedance (Hi-Z) state during the short-circuit period as shown in FIG. 20, for example. This operation can be easily accomplished when a switch is disposed inside the row electrode driver unit, for example, and connection of VY is cut off in match with High of SHT. In FIG. 20, VY becomes VGON in synchronism with the second CL3 pulse and write of the column voltage is executed. The output is not brought into the Hi-Z state during this period because it does not have much technical meaning.

The fourth embodiment described above can acquire the power consumption saving effect in the same way as in the first to third embodiments in the pixel structure in which the terminal of the holding capacitance is connected to the row of a preceding stage of a given stage.

Figure 21:
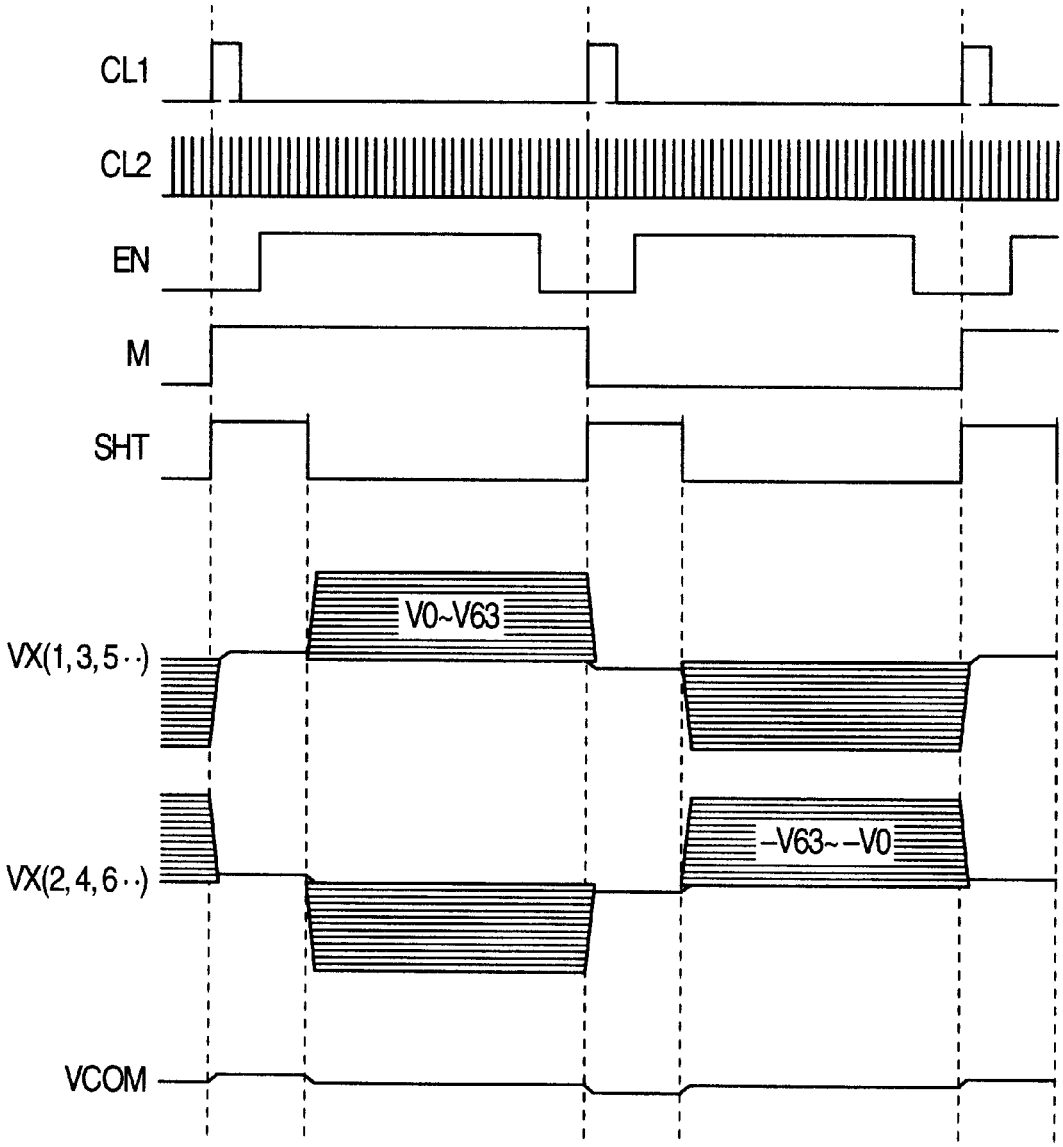
FIG. 21 is a timing chart showing an operation of a liquid crystal display device according to the fifth embodiment of the present invention.

Though the foregoing embodiments have been explained about Vcom modulation drive by way of example, the present invention can be applied also to dot inversion drive and column inversion drive on the basis of the same concept. FIG. 21 shows the voltage waveforms of the column voltage and common voltage in the drive systems as the fifth embodiment of the present invention.

The embodiments of the present invention provide the following effects in the active matrix type liquid crystal display device in which the effective value of the applied voltage controls the transmission factor (brightness) of each pixel:

The voltage can be substantially shifted to the midpoint of alternation magnitude without consuming power when the column electrode and the common electrode sandwiching the liquid crystal between them are temporarily short-circuited at the timing of alternation;

Power consumption can be saved when the applied voltage to the row electrode as the signal for selecting the row is temporarily short-circuited to GND; and The power consumption reduction methods described above can be applied without unnecessary power consumption to the pixel structure for connecting the terminal of the holding capacitance to the row of a preceding stage of a given stage when the applied voltage to the row electrode is brought into the high impedance state during the short-circuit period described above.

What is claimed is:

1. An active matrix type display device comprising:

a display panel including column electrodes and row electrodes arranges in a matrix form, a common electrode disposed opposite to the column electrodes and the row electrodes, and pixel units disposed at intersection points between the column electrodes and the row electrodes, a pixel unit being connected to a column electrode, a row electrode and the common electrode;

a common electrode driver circuit for outputting a common voltage to the common electrode, the common voltage being in common to the pixel units;

a column electrode driver circuit for selecting a column voltage corresponding to display data applied externally, from among a plurality of column voltages corresponding to a plurality of gray-scales, and outputting the column voltage selected to the column electrodes;

a row electrode voltage driver circuit for outputting a row voltage to the row electrodes, the row voltage causing the pixel units to be in an "ON" state;

a power supply circuit for generating the common voltage, the plurality of column voltages and the row voltage, and for outputting the common voltage, the plurality of column voltages and the row voltage to the common electrode driver circuit, the column electrode driver circuit and the row electrode driver circuit, respectively;

a first switching circuit disposed on the column electrodes between the pixel units and the column electrode driver circuit; and a second switching circuit disposed on the common electrode between the pixel units and the common electrode driver circuit, wherein:

the first switching circuit switches into either connection between the column electrodes on a side of the pixel units and the common electrode, or connection between the column electrodes on the side of the pixel units and the column electrode driver circuit, when the second switching circuit is turned "OFF", the first switching circuit makes connection between the column electrodes on the side of the pixel units and the common electrode without making connection between the column electrodes on the side of the pixel units and the column electrode driver circuit, and when the second switching circuit is turned "ON", the first switching circuit makes connection between the column electrodes on the side of the pixel units and the column electrode driver circuit without making connection between the column electrodes on the side of the pixel units and the common electrode.

2. The display device according to claim 1, wherein, when the first switching circuit makes connection between the column electrodes on the side of the pixel units and the common electrode, the column electrodes on the side of the pixel units and the common electrode are short-circuited with each other.

3. The display device according to claim 1, wherein, for every one or more scanning periods, the first switching circuit makes connection between the column electrodes on the side of the pixel units and the common electrode during a predetermined period, and thereafter makes connection between the column electrodes on the side of the pixel units and the column electrode driver circuit.

4. The display device according to claim 1, wherein:

the pixel units perform switching operation of a potential to alternate between a positive polarity and a negative polarity for every one or more scanning periods, and the first switching circuit, in synchronism with the switching operation, makes connection between the column electrodes on the side of the pixel units and the common electrode during a predetermined period, and thereafter makes connection between the column electrodes on the side of the pixel units and the column electrode driver circuit.

5. The display device according to claim 4, wherein, where the switching operation is performed for every plural scanning periods, the predetermined period is a first scanning period.

6. A display driver circuit for driving an active matrix type display panel including column electrodes and row electrodes arranged in a matrix form, a common electrode disposed opposite to the column electrodes and the row electrodes, and pixel units disposed at intersection points between the column electrodes and the row electrodes, a pixel unit being connected to a column electrode, a row electrode and the common electrode, the display driver circuit comprising:

a column electrode driver circuit for selecting a column voltage corresponding to a display data applied externally, from among a plurality of column voltages corresponding to a plurality of gray-scales generated by a power supply circuit;

a first switching circuit disposed on the column electrodes between the pixel units and the column electrode driver circuit; and a second switching circuit disposed on the common electrode between the pixel units and a common electrode driver circuit;

wherein:

the first switching circuit switches into either connection between the column electrodes on a side of the pixel units and the common electrode, or connection between the column electrodes on the side of the pixel units and the column electrode driver circuit, when the second switching circuit is turned "OFF", the first switching circuit makes connection between the column electrodes on the side of the pixel units and the common electrode without making connection between the column electrodes on the side of the pixel units and the column electrode driver circuit, and when the second switching circuit is turned "ON", the first switching circuit makes connection between the column electrodes on the side of the pixel units and the column electrode driver circuit without making connection between the column electrodes on the side of the pixel units and the common electrode.

7. The display driver circuit according to claim 6, wherein, when the first switching circuit makes connection between the column electrodes on the side of the pixel units and the common electrode, the column electrodes on the side of the pixel units and the common electrode are short-circuited with each other.

8. display driver circuit according to claim 6, wherein, for every one or more scanning periods, the first switching circuit makes connection between the column electrodes on the side of the pixel units and the common electrode during a predetermined period, and thereafter makes connection between the column electrodes on the side of the pixel units and the column electrode driver circuit.

9. The display driver circuit according to claim 6, wherein:

the pixel units perform switching operation of a potential to alternate between a positive polarity and a negative polarity for every one or more scanning periods, and the first switching circuit, in synchronism with the switching operation, makes connection between the column electrodes on the side of the pixel units and the common electrode during a predetermined period, and thereafter makes connection between the column electrodes on the side of the pixel units and the column electrode driver circuit.

10. The display driver circuit according to claim 9, wherein, where the switching operation is performed for every plural scanning periods, the predetermined period is a first scanning period.

* * * * *